United States Patent [19]

Vinz

[11] 4,228,661

[45] Oct. 21, 1980

[54] METHOD AND APPARATUS FOR REDISTRIBUTING HEAT WITHIN A ROOM

[76] Inventor: Siegfried Vinz, Neuwiesenrebenstr. 44, D-7505 Ettlingen, Fed. Rep. of Germany

[21] Appl. No.: 836,962

[22] Filed: Sep. 27, 1977

[30] Foreign Application Priority Data

Oct. 1, 1976 [DE] Fed. Rep. of Germany ..... 2644372

[51] Int. Cl.[3] ..... F24B 13/00

[52] U.S. Cl. ..... 62/89; 62/324; 165/2

[58] Field of Search ..... 62/324, 160, 324 D; 165/26, 29, 49, 56, 2; 237/2 B

[56] References Cited

U.S. PATENT DOCUMENTS

| | | | |
|---|---|---|---|
| 2,533,407 | 12/1950 | Skillman | 165/49 |
| 2,729,431 | 1/1956 | Little | 165/56 |
| 3,292,388 | 12/1966 | Schuchardt | 62/324 |

*Primary Examiner*—Samuel Scott
*Assistant Examiner*—Lee E. Barrett
*Attorney, Agent, or Firm*—Craig & Antonelli

[57] ABSTRACT

A method of redistributing heat within a room or for operating a heating system for a dwelling, working or assembly room, together with apparatus therefor, wherein at least one heat pump is employed to extract heat from air of the room on the expansion side (cold side) of the heat pump and to re-emit on the compression side (hot side) of the heat pump the heat to the room in the form of radiation from at least one heat radiation member. The heat exchange may take place directly between the working fluid of the heat pump and the air and the heat radiation member or indirectly employing secondary heat medium circuits containing, for example, water.

15 Claims, 3 Drawing Figures

METHOD AND APPARATUS FOR REDISTRIBUTING HEAT WITHIN A ROOM

FIELD OF THE INVENTION

The invention relates to a method and apparatus for redistributing heat within a room and for operating a heating system for a dwelling, working or assembly room; with heat pumps as means for distributing or producing heat adapted to obtain the heat from an available heat medium on their expansion side (cold side) and to deliver such heat on their compression side (hot side) to the medium which is to be heated.

The theoretical principles and practical effects of heating systems with heat pumps as heat generating means are generally known from the technical literature; practical embodiments have been taken up only very recently although very good experience has been available from a few embodiments which have already been installed for several decades. A powerful impetus, has evidently been required to give fresh encouragement to development in this field and this has been supplied by the increasing cost of primary energy.

Heating systems with heat pumps are generally operated by low grade heat being obtained from a medium with a large heat reserve, for example a large waterway, groundwater or soil, said heat is then transformed by means of the heat pump into a high grade heat and the high grade heat thus obtained is delivered to a medium to be heated, for example water or air. Under average conditions, it is possible for a very substantial part of the heat required for heating to be obtained from the relevant heat storage medium, i.e. for such heat to be obtained quasi-free of cost. Systems of this kind, which can be used for example for heating dwelling rooms or hot water, have hitherto generally been operated on the principle of obtaining inexpensive heat energy, as already described. The heat has hitherto always been given up to room heating systems by convective heat exchange with the room air through heat exchangers constructed in the manner of radiators or convectors of central heating systems.

It is well known that human beings feel radiated heat to be substantially more pleasant than the conventional heated room air. The physiological feeling of comfort from radiated heat is stimulated to a much greater extent, even at low air temperatures, than in the opposite case of heat absorption from environmental air at high temperature. Medical considerations therefore frequently demand the development of heating systems which transfer a greater proportion of sensible heat by radiation. However, apart from known electric heat radiators such a requirement can be achieved only with difficulty in actual practice.

SUMMARY OF THE INVENTION

Proceeding from this situation, it is an object of the invention to propose a method of redistributing heat within a room or for operating a heating system for a dwelling, working or assembly room with at least one heat pump as a heat generating means which obtains heat on an expansion side thereof from an available heat medium and delivers said heat on a compression side thereof to a medium which is to be heated. According to the invention this problem is solved by heat being obtained directly or indirectly through an intermediate medium accompanied by a reduction in the temperature of the room air and being delivered to radiation members which radiate the heat and are disposed within the boundary surfaces of a room. Generally, but not essentially, heat extracted from the air of a room will be re-emitted by radiation members located in the same said room.

It is obvious that in performing the method according to the invention the room is not heated to any great extent in the intrinsic sense but that the existing heat content is continuously converted from air heat into radiated heat, which is felt to be more pleasant, the heat content being slightly increased by the electric energy used for operating the heat pump; the heat which is constantly lost outside the system can be replaced by conventional heating devices based, e.g. on heat convection. To perform the method according to the invention there is provided apparatus including at least one heat pump, at least one heat exchanger for transmitting sensible heat obtained from an air space of a room to be heated to a cold side of the heat pump, and situated in or near the air space of the room, and at least one heat exchanger constructed as a surface heating radiator disposed adjacent boundary surfaces of the room for receiving heat from a compression side of the heat pump and for delivering such heat substantially in the form of heat radiation to the room to be heated. By using surface radiators, that is to say radiators with a large surface area the entire system can be operated at relatively low temperatures, a feature which also assists in conveying a feeling of comfort.

One simple embodiment of the invention provides that the primary heat exchangers associated with the heat pump on the expansion side (cold side) and on the compression side (hot side), the pump side of which heat exchangers carry the direct heat pump medium flow, are provided respectively as means for exchanging heat with the room air or as heat radiators.

For plants with a larger output and for more complicated space conditions it is on the other hand recommended that a secondary heat medium circuit, more particularly operated with water as heat medium, is associated with each of the primary heat exchangers associated with the heat pump respectively on the expansion side and on the compression side, that the secondary circuit on the expansion side absorbs sensible room air heat through at least one secondary heat exchanger and supplies such heat to the primary heat exchanger and that the secondary circuit on the compression side receives the sensible heat from the primary heat exchanger and radiates said heat via the secondary heat exchangers, constructed as at least one surface heat radiator, into the room which is to be heated. A plant perfected in this manner is shown to be advantageous if particularly large surfaces, situated in several planes, are to be provided with heat radiators or if heat is to be obtained from the room air from several places which are separated from each other. Depending on the given conditions, a secondary circuit can be associated either only with a primary heat exchanger on the expansion side or only with a primary heat exchanger on the compression side or it can be associated with both heat exchangers.

One advantageous further embodiment of the invention provides that the surface heat radiators are disposed at a short distance from the boundary surfaces of the room (walls, ceiling, floor) so as to leave an air gap and seal strips for forming air guide ducts are disposed at specified places between the boundary surfaces and the heat radiators. These steps open numerous additional possibilities.

For example, the heat exchangers which are on the cold side can be disposed in the air gap between the boundary surfaces and the heat radiators and can be advantageously situated in ventilating shafts or they can be associated with an air pump for supplying the warm air. This arrangement not only offers the advantage of allowing the mechanical apparatus to remain concealed, but the air gap itself acts as a ventilating shaft and ensures that a powerful heat exchange takes place. It is also desirable for the purpose of an architecturally advantageous arrangement of the room to arrange not only the heat exchangers which are on the cold side but also the entire heat pump system in the air gap between the boundary surfaces and the heat radiators.

In a preferred embodiment, the heat radiators arranged in this manner are provided with several or a large number of ducts extending from the external surface to the internal surface to permit an exchange of air from the room to the air gap between the boundary surfaces and the surface heat radiators or vice versa.

It appears advantageous to provide the external surfaces of the surface heat radiators nearest to the boundary surfaces of the room with thermal insulation to prevent a substantial part of the heat supplied to the heat radiators being dissipated to the air which is situated in the air gap between the heat radiators and the boundary surfaces.

BRIEF DESCRIPTION OF THE DRAWINGS

Embodiments of apparatus according to the invention, will now be described, by way of example only by reference to the strictly diagrammatic basic sketches in the accompanying drawings, in which.

DESCRIPTION OF THE PREFERRED EMBODIMENTS

Figure 1:
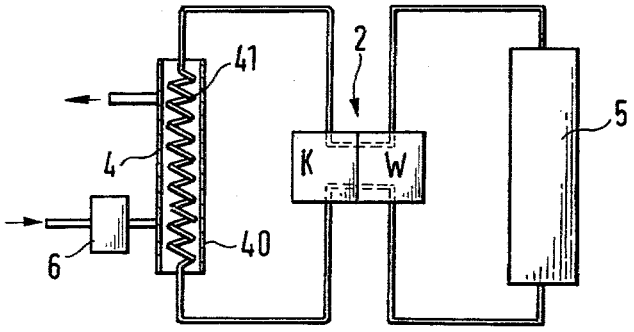
FIG. 1 is a simplest embodiment of a heating system with a heat pump.

In the apparatus according to FIG. 1, a primary, absorptive, heat exchanger 4 (cold side) and a primary, emissive heat exchanger 5 (hot side) associated with a heat pump 2, whose expansion part (cold part) is designated "K" and whose compression part (hot part) is designated "W", are used directly as heat exchangers for the room which is to be heated (in which the distribution of heat is to be controlled). In the illustrated embodiment, the heat exchanger 4 on the cold side comprises a pipe coil 41 through which the heat pump medium flows and which is surrounded by a jacket tube 40. Room air flows through the jacket tube under the action of an air pump 6 and gives up part of its sensible heat to the heat pump medium which was cooled due to the preceding expansion. The heat exchanger 5 for heating the room is constructed as an imperforate heat-radiating panel through the interior of which the heat pump medium flows.

Figure 2:
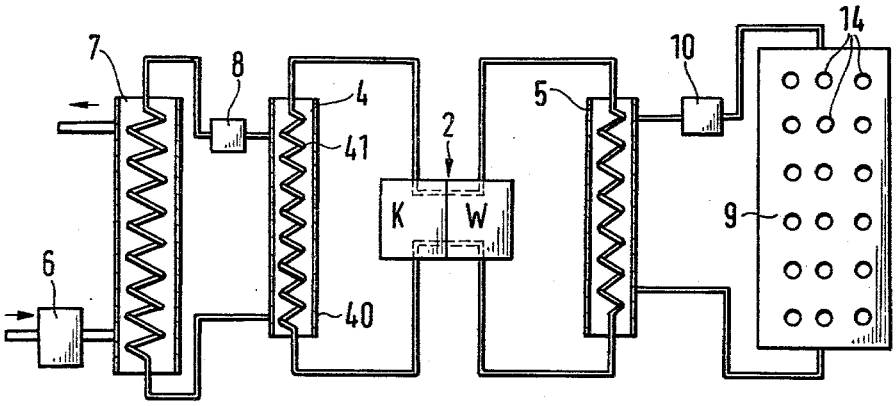
FIG. 2 is a perfected embodiment of a heating system.

FIG. 2 shows a perfected system. In this system, a secondary heat medium circuit, advantageously operated with water as heat medium but which can also be operated with suitable other liquids, associated with each primary heat exchanger 4 or 5. In this system a secondary, absorptive, heat exchanger 7 with a circulating pump is associated with the primary heat exchanger 4 and a secondary emissive heat exchanger 9 with a circulating pump 10 is associated with the primary heat exchanger 5. As can readily be seen by reference to FIG. 2, the functions of the primary heat exchangers 4, 5 as regards room heating in this embodiment have been taken over by the secondary heat exchangers 7 and 9, by comparison with FIG. 1. The last-mentioned heat exchangers effect heat exchange with the room that is to be heated by heat removal 7 or by radiation 9, the heat medium of the relevant secondary circuit functioning as exchange medium while the primary heat exchangers 4, 5 merely exchange heat between the medium of the heat pump and heat medium of the secondary circuit. By contrast to the simplest embodiment illustrated in FIG. 1, the arrangement according to FIG. 2 offers important advantages. By selecting a suitable heat medium, for example water, the secondary circuits can be arranged for unpressurized operation and they can be constructed for supplying a plurality of secondary heat exchangers while the choice of their installation site and pipeline layout is substantially a matter of free choice.

Figure 3:
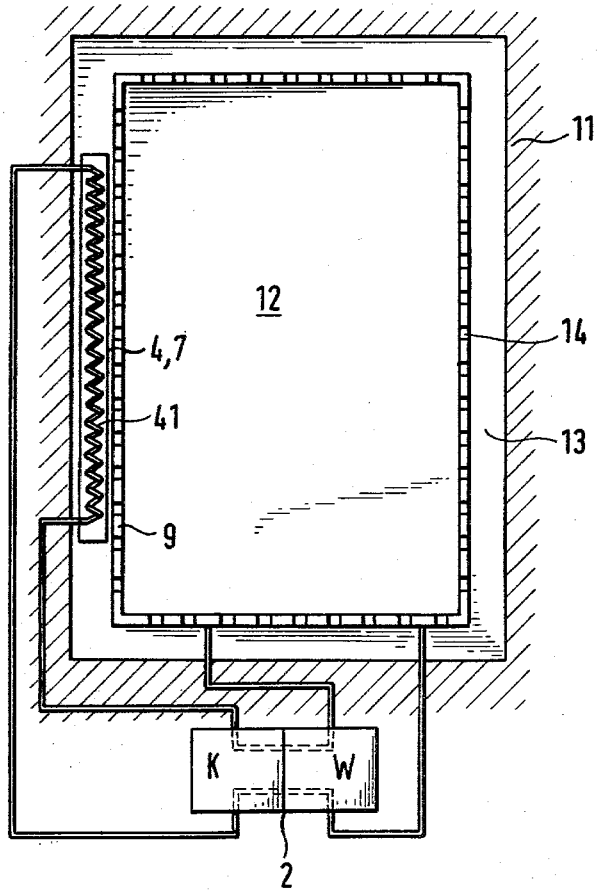
FIG. 3 shows a greatly simplified plan view of a dwelling room with an associated heating system.

FIG. 3 shows a plan view of a basic diagram of a room heating system in which surface heat radiators, which cover substantial parts of the wall surfaces, are situated at a short distance from boundary walls 11 of a room 12 which is to be heated. As shown in FIG. 2, these heat radiators have ducts 14 extending from one to the other of their walls and permit the exchange of air from the interior of the room to the air gap 13 which remains between the boundary walls and the system of heat radiators. In the interests of simplifying the drawing, this Figure shows only a simplified heat pump heating system according to FIG. 1; in a system having this embodiment, it will however be far more advantageous to provide a heating system according to FIG. 2. The heat exchanger 4 or 7 for obtaining heat from the room air is disposed in the air gap 13, for reasons of space as well as for reasons of heat technology or for aerodynamic reasons; this is because the air gap itself acts as a ventilating shaft so that the heat exchanger 4 or 7 on the cold side does not require sheathing to produce a ventilating action but can be freely suspended in the air gap as a simple pipe coil 41. To assist the ventilating action resulting from heat convection, it is possible for seal strip of plastics material to be mounted at the places provided to this end between the boundary walls and the system of heat radiators so that the air gap is subdivided by the said seal strips into rising and/or horizontal ducts.

I claim:

1. A method of redistributing heat within a room by employing at least one heat pump which is adapted to obtain heat on an expansion side from a supply of heat and to deliver such heat on its compression side to a medium to be heated, comprising the steps of:

recirculating the air of the room through channels between boundary surfaces of the room and radiation members disposed adjacent said boundary surfaces back into the room, and removing heat exclusively from the recirculating air of the room with said heat pump and simultaneously delivering it back to the room by said radiation members.

2. A method according to claim 1, characterized in that the step of removing heat is performed by removing heat from the air in the room directly by the heat pump medium and wherein said medium delivers said heat directly to said radiation members in said heat delivering step.

3. A method according to claim 1, characterized in that the heat is removed indirectly by means of a heat carrier means from the air of the room and is delivered indirectly by said heat carrier means to said radiation members.

4. A method according to claim 3, characterized in that secondary heat carrier circuits are employed to effect said indirect removing and delivering of heat.

5. A method according to claim 4, wherein water is employed as the heat carrier medium of the secondary circuits.

6. A method for operating a heating system for at least one room and having at least one heat pump as a means for transferring heat from a supply of heat and adapted to obtain heat from an available heat supply on its expansion side and to deliver such heat on its compression side to a medium to be heated, comprising the steps of delivering heat to a room by radiating members disposed adjacent the boundary surfaces of the room, and obtaining said heat directly or by an intermediate heat carrier means so as to reduce the temperature of the air in the room by circulating the air of the room through channels formed between said boundary surfaces and said radiating members back into said room.

7. A method of operating a heating system according to claim 6, characterized in that the step of delivering the heat is carried out with the radiating members being distributed over all the boundary surfaces of the room in a manner so as to produce symmetric radiation.

8. Apparatus for operating a heating system having at least one heat pump and comprising at least one primary heat exchanger means associated with the expansion side of said heat pump for obtaining heat from air of a room and for transmitting said heat obtained to the expansion side of the heat pump, said heat exchanger means being situated in the room which is to be heated, at least one surface heat radiating primary heat exchanger means associated with the heat pump on the compression side thereof and disposed adjacent a boundary surface of the room for receiving heat from the compression side of the heat pump and for delivering such heat substantially in the form of heat radiation to the said room, and means for bringing the air of the room into heat exchange relationship with the primary heat exchanger and returning said air back into the room after removal of heat therefrom.

9. Apparatus according to claim 8, comprising a secondary heat medium circuit associated with each of the primary heat exchanger means, the secondary circuit associated with the primary heat exchanger on the expansion side of the heat pump being arranged for absorbing sensible heat from the room air through heat exchangers and for supplying such heat to the primary heat exchanger means on the expansion side of the heat pump, and the secondary circuit associated with the heat radiating primary exchanger means on the compression side of the heat pump being arranged for receiving the sensible heat from the heat radiating primary heat exchanger means and for radiating said heat via heat exchangers, constructed as surface head radiators, into the room to be heated.

10. Apparatus according to claim 9, characterized in that the surface radiators are disposed at a short distance from the boundary surfaces of the room so as to leave an air gap therebetween, and further comprising seal strips for forming air guide ducts disposed between the boundary surfaces and the said heat radiators.

11. Apparatus according to claim 10, comprising thermal insulation associated with external surfaces of the heat radiators nearest to the boundary surfaces of the room.

12. Apparatus according to claim 10, characterized in that the surface heat radiators are provided with ducts which extend from an external surface to an internal surface thereof and permit an air exchange between the room and the air gap between the boundary surfaces and the surface heat radiators.

13. Apparatus according to claim 10, characterized in that the heat exchangers on the expansion side of the heat pump are disposed in the air gap between the boundary surfaces and the surface heat radiators and that they are situated in ventilating shafts for supplying the room air.

14. Apparatus according to claim 10, characterized in that the heat exchangers on the expansion side of the heat pump are disposed in the air gap between the boundary surfaces and the surface heat radiators and that they are associated with an air pump for supplying the room air.

15. Apparatus according to claim 10, characterized in that the entire apparatus except for said heat pump and heat radiators is situated in the air gap between the boundary surfaces and the heat radiators at the outside of the heat radiators.

* * * * *